US008122544B1

(12) United States Patent
Sandefur

(10) Patent No.: US 8,122,544 B1
(45) Date of Patent: Feb. 28, 2012

(54) BABY FEEDING SYSTEM

(76) Inventor: Lindsey T. Sandefur, Winter Garden, FL (US)

( * ) Notice: Subject to any disclaimer, the term of this patent is extended or adjusted under 35 U.S.C. 154(b) by 0 days.

(21) Appl. No.: 13/136,193

(22) Filed: Jul. 26, 2011

Related U.S. Application Data

(60) Provisional application No. 61/368,208, filed on Jul. 27, 2010.

(51) Int. Cl.
*A47D 13/00* (2006.01)

(52) U.S. Cl. ..... 5/655; 5/731

(58) Field of Classification Search ..... 5/655, 652, 5/731–734, 632, 630, 946, 93.1, 655.9, 740, 5/953

See application file for complete search history.

(56) References Cited

U.S. PATENT DOCUMENTS

| | | | | | |
|---|---|---|---|---|---|
| 1,092,298 | A * | 4/1914 | Schwarz | 5/513 |
| 2,973,889 | A * | 3/1961 | Phillips | 294/140 |
| 3,729,752 | A * | 5/1973 | Huggins | 5/93.1 |
| 4,866,449 | A * | 9/1989 | Gaffney | 342/151 |
| 4,890,346 | A * | 1/1990 | Rist | 5/658 |
| 4,935,973 | A * | 6/1990 | Behrman | 5/2.1 |
| 5,127,422 | A * | 7/1992 | Colon | 5/655 |
| 5,351,348 | A * | 10/1994 | Beger | 5/420 |
| 5,360,258 | A * | 11/1994 | Alivizatos | 297/440.11 |
| 5,551,109 | A * | 9/1996 | Tingley et al. | 5/655 |
| 5,787,524 | A * | 8/1998 | Butnik | 5/93.1 |
| 5,800,368 | A * | 9/1998 | Klingemann et al. | 602/1 |
| 7,017,204 | B1 * | 3/2006 | Fertil et al. | 5/93.1 |
| 7,406,724 | B2 * | 8/2008 | Miller | 5/93.1 |
| 7,418,752 | B2 * | 9/2008 | Kemm | 5/655 |
| 7,698,764 | B2 * | 4/2010 | Kemm | 5/655 |
| 2008/0092299 | A1 * | 4/2008 | Kemm | 5/655 |
| 2009/0056025 | A1 * | 3/2009 | Kemm | 5/655 |

* cited by examiner

*Primary Examiner* — Robert G Santos

(57) ABSTRACT

A base has upper and lower surfaces. The base has front and back edges. First and second side walls extend from the base. A center wall extends from the base spaced equally between the side walls. The side walls and the center wall have concave upper edges. The upper edges are adjacent to the back edge being at an elevation greater than at the front edge. The center wall divides the system into first and second reclining surfaces. The upper edges of the side and center walls are at an elevation above the upper edges of the reclining surfaces. Similarly configured first and second leg dividers extend vertically from the base adjacent to the front wall. The first and second leg dividers are in the first and second reclining surface.

6 Claims, 3 Drawing Sheets

FIG. 3
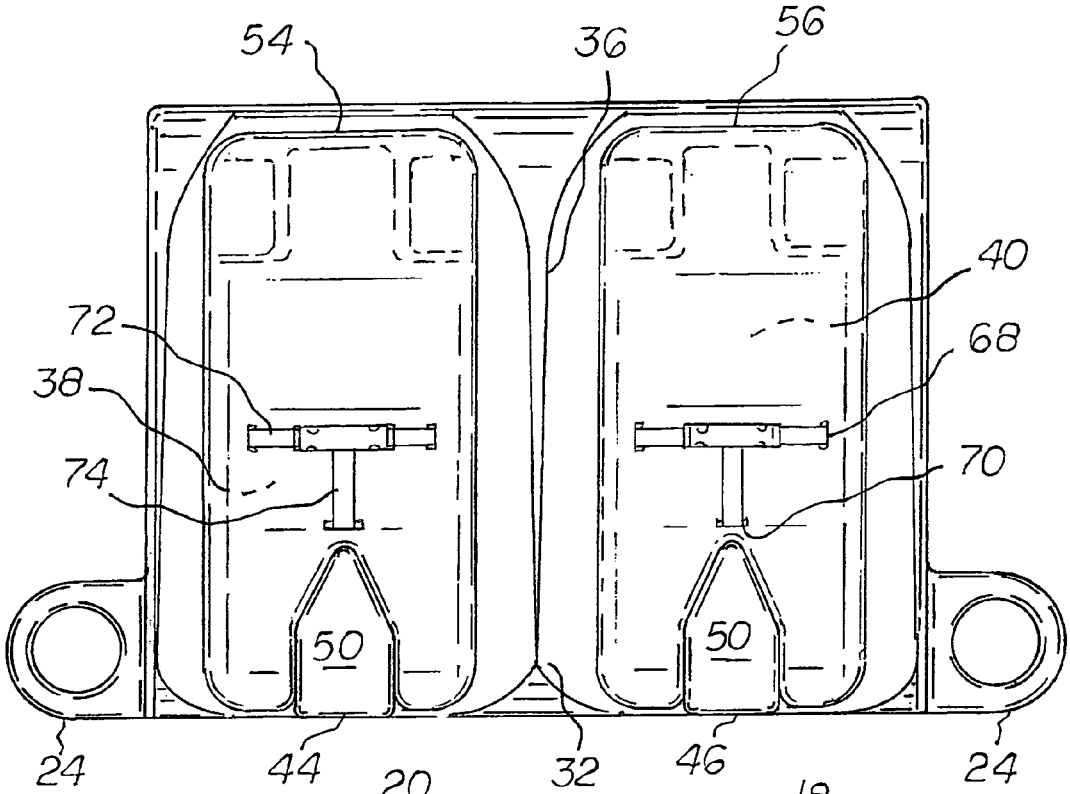
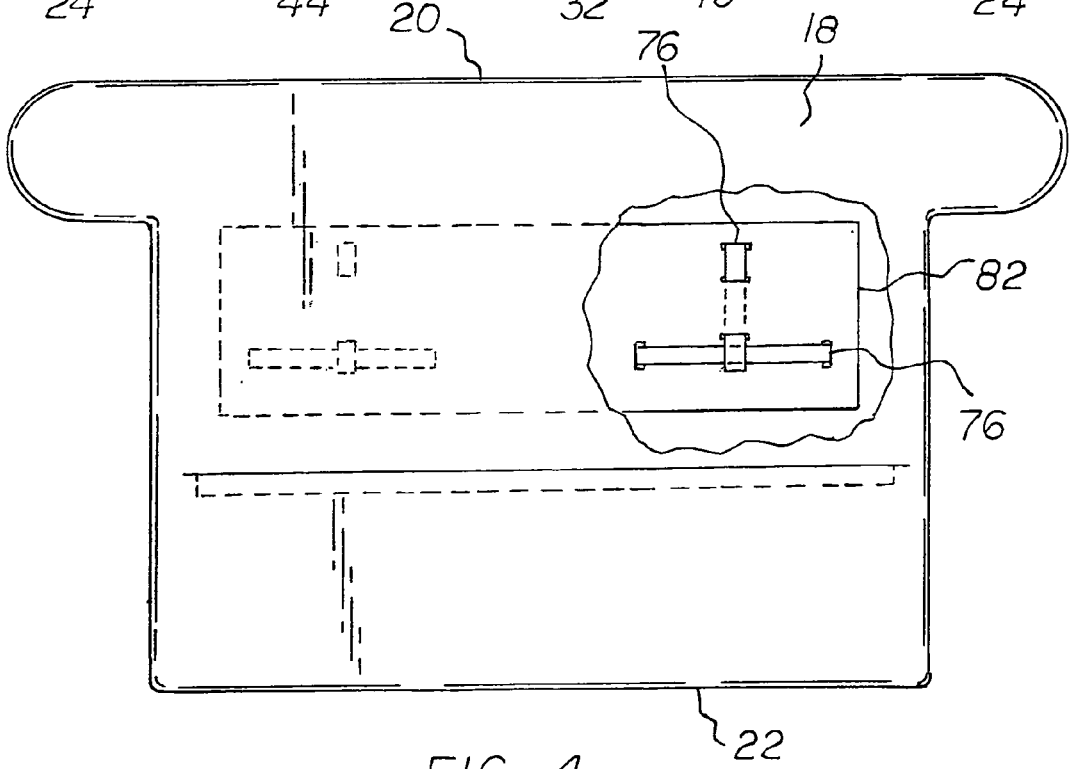
FIG. 4

FIG. 5
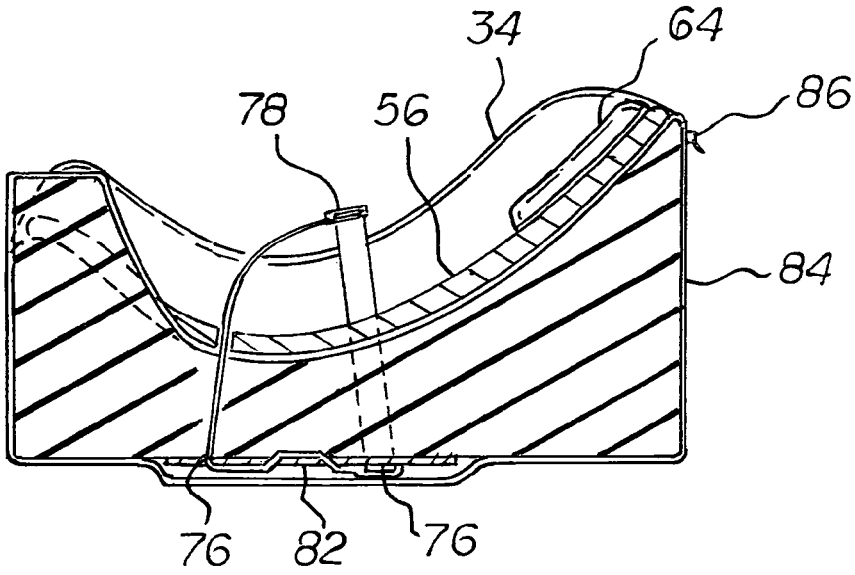
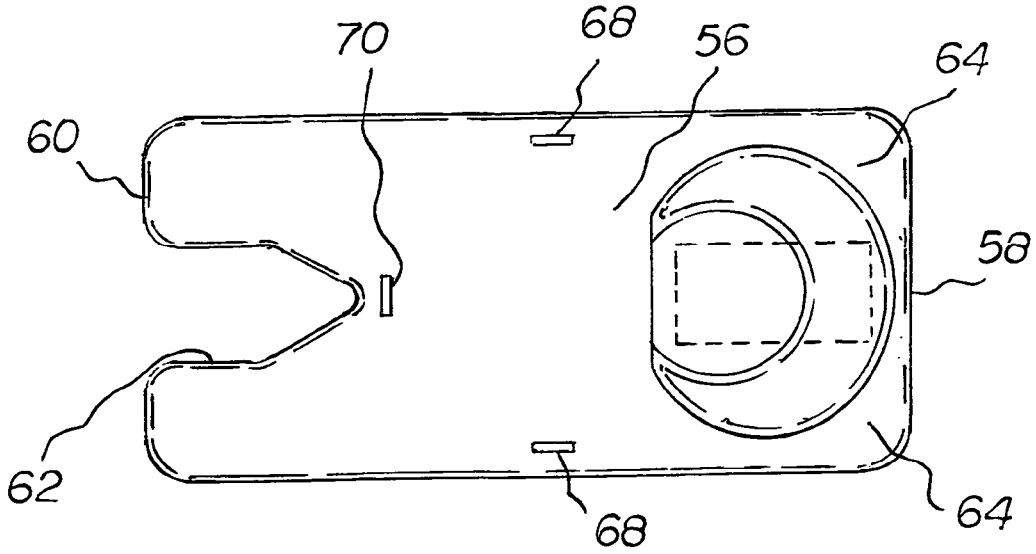
FIG. 6

BABY FEEDING SYSTEM

RELATED APPLICATION

The present non-provisional patent application is based upon Provisional Application No. 61/368,208, filed Jul. 27, 2010, the subject matter of which is incorporated herein by reference.

BACKGROUND OF THE INVENTION

Field of the Invention

The present invention relates to a baby feeding system and more particularly pertains to receiving and retaining two laterally spaced babies while feeding and for supporting an elbow of a care giver during feeding, the receiving and supporting being done in a safe, convenient and economical manner.

SUMMARY OF THE INVENTION

In view of the disadvantages inherent in the known types of feeding systems of known designs and configurations now present in the prior art, the present invention provides an improved baby feeding system. As such, the general purpose of the present invention, which will be described subsequently in greater detail, is to provide a new and improved baby feeding system and method which has all the advantages of the prior art and none of the disadvantages.

To attain this, the present invention essentially comprises a baby feeding system. First provided is a base. The base has an upper surface. The base has a lower surface. The lower surface has a generally rectangular configuration over the majority of its extent. The base has a front edge. The base has a back edge. The front edge is wider than the back edge. The base has generally hemispherical projections. The projections extend laterally from the base adjacent to the front edge. Each projection has an upwardly facing recess. A rigid cup-shaped holder is positioned in each recess for the removable receipt of a baby bottle. In this manner a baby bottle is removably supported at a convenient location for the care giver.

Parallel first and second side walls are provided. The side walls are similarly configured. The side walls extend vertically from the base between the front and back edges. A center wall is provided. The center wall extends vertically from the base. The center wall is provided parallel with and spaced equally between the side walls. The side walls have concave upper edges. The center wall has a concave upper edge. The upper edges of the side and center walls are provided adjacent to the back edge. The back edge is provided at an elevation greater than at the front edge. The center wall divides the system into a first reclining surface. A similarly configured second reclining surface is provided. The upper edges of the side and center walls are at an elevation above the upper edges of the reclining surfaces.

Similarly configured first and second leg dividers are provided. The leg dividers extend vertically from the base adjacent to the front wall. Each leg divider is in a pentagonal configuration. The first leg divider is in the first reclining surface. The second leg divider is in the second reclining surface.

Elbow rests for the care giver are provided next. The elbow rests are located upon the first and second leg dividers above the front edge.

Further provided are first and second mats. The mats are removably received in the first and second reclining surfaces.

Each mat has an upper end. The upper end is positionable at the back edge. Each mat has a lower end. The lower end is positionable adjacent to the front edge. The lower edges of the first and second mats have pentagonal cutouts. In this manner the first and second leg dividers are received. A C-shaped pillow is provided for each mat. Each pillow is removably coupled, as by hook and loop fasteners, to each mat adjacent to the back edge. The pillow of each mat is adjustably positioned. In this manner the head of a baby may be properly received.

Provided next is a plurality of slits. The slits are formed in each mat and each reclining surface. The slits include laterally spaced longitudinal slits. The slits include a lower transverse slit. First and second waist straps are provided. The waist straps extend through the longitudinal slits. Crotch straps are provided. Crotch straps extend through the transverse slits. The lower surface of the base has longitudinal and transverse slots. In this manner the straps may pass. First and second buckles are provided. The buckles releasably couple the waist and crotch straps. In this manner the babies are secured.

Extended life for the base is achieved through a 2 mil pvc stiffening sheet on the lower surface of the base. Slits extend there through for the passage of the belts. In this manner, wear to the base is abated.

The base is adapted to be fabricated of any of a wide variety of materials. One such material is memory foam with a fabric cover, preferably a waterproof 100 percent polyester, positionable over the base. The fabric cover is fabricated of any of a plurality of materials, natural or synthetic, or blends thereof. The cover is formed with a passageway peripherally along the back and bottom. A plastic zipper fastener is utilized at the passageway peripherally along the back and bottom. This allows for the opening and closing thereof whereby the cover may be removed for laundering purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baby feeding system which has all of the advantages of the prior art feeding systems of known designs and configurations and none of the disadvantages.

It is another object of the present invention to provide a new and improved baby feeding system which may be easily and efficiently manufactured and marketed.

It is further object of the present invention to provide a new and improved baby feeding system which is of durable and reliable constructions.

An even further object of the present invention is to provide a new and improved baby feeding system which is susceptible of a low cost of manufacture with regard to both materials and labor, and which accordingly is then susceptible of low prices of sale to the consuming public, thereby making such baby feeding system economically available to the buying public.

Even still another object of the present invention is to provide a baby feeding system for receiving and retaining two laterally spaced babies while feeding and for supporting an elbow of a care giver during feeding, the receiving and supporting being done in a safe, convenient and economical manner.

Lastly, it is an object of the present invention to provide a new and improved baby feeding system. A base has upper and lower surfaces. The base has front and back edges. First and second side walls extend from the base. A center wall extends from the base spaced equally between the side walls. The side walls and the center wall have concave upper edges. The upper edges are adjacent to the back edge being at an elevation greater than at the front edge. The center wall divides the system into first and second reclining surfaces. The upper edges of the side and center walls are at an elevation above the upper edges of the reclining surfaces. Similarly configured first and second leg dividers extend vertically from the base adjacent to the front wall. The first and second leg dividers are in the first and second reclining surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3 and 4 are plan and bottom views taken along lines 3-3 and 4-4 of FIG. 2.

FIG. 5 is a cross sectional view taken along lines 5-5 of FIG. 2.

FIG. 6 is a plan view of the removable pad shown in FIGS. 3 and 5.

The same reference numerals refer to the same parts throughout the various Figures.

DESCRIPTION OF THE PREFERRED EMBODIMENT

Figure 1:
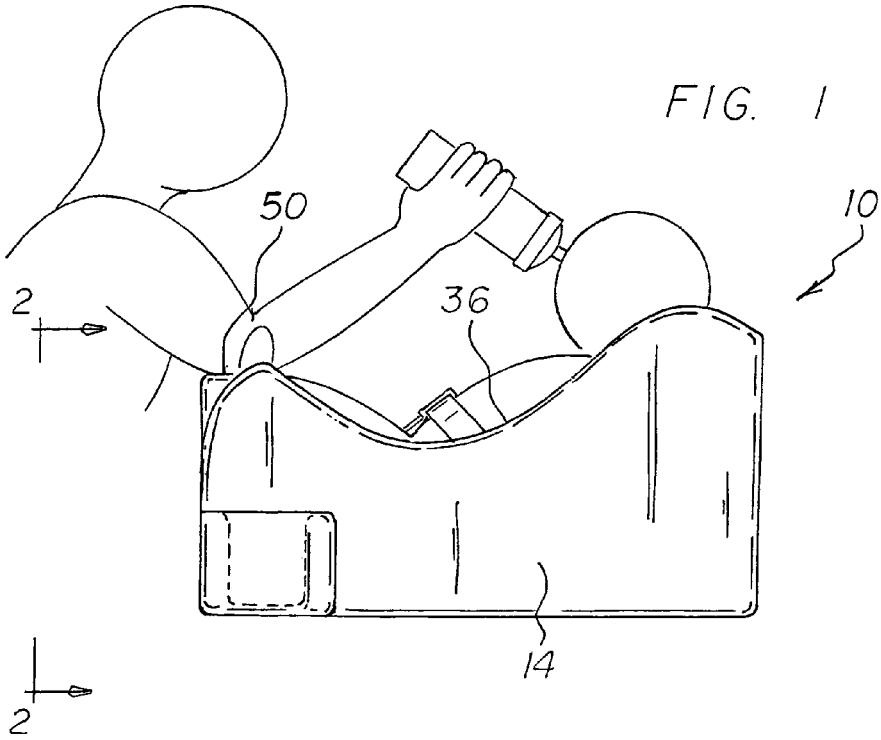
FIG. 1 is a side elevational view of a baby feeding system constructed in accordance with the principles of the present invention.
Figure 2:
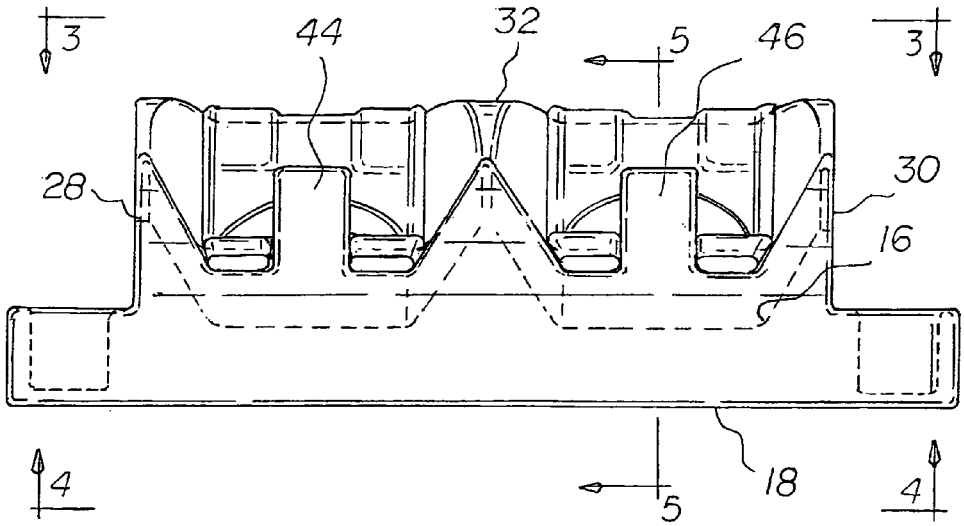
FIG. 2 is a front elevational view taken along line 2-2 of FIG. 1.

With reference now to the drawings, and in particular to FIG. 1 thereof, the preferred embodiment of the new and improved baby feeding system embodying the principles and concepts of the present invention and generally designated by the reference numeral 10 will be described.

The present invention, the baby feeding system 10 is comprised of a plurality of components. Such components in their broadest context include a base, first and second side walls and first and second leg dividers. Such components are individually configured and correlated with respect to each other so as to attain the desired objective.

First provided is a base 14. The base has an upper surface 16. The base has a lower surface 18. The lower surface has a generally rectangular configuration over the majority of its extent. The base has a front edge 20. The base has a back edge 22. The front edge is wider than the back edge. The base has generally hemispherical projections 24. The projections extend laterally from the base adjacent to the front edge. Each projection has an upwardly facing recess. A rigid cup-shaped holder is positioned in each recess for the removable receipt of a baby bottle. In this manner a baby bottle is removably supported at a convenient location for the care giver.

Parallel first and second side walls 28, 30 are provided. The side walls are similarly configured. The side walls extend vertically from the base between the front and back edges. A center wall 32 is provided. The center wall extends vertically from the base. The center wall is provided parallel with and spaced equally between the side walls. The side walls have concave upper edges 34. The center wall has a concave upper edge 36. The upper edges of the side and center walls are provided adjacent to the back edge. The back edge is provided at an elevation greater than at the front edge. The center wall divides the system into a first reclining surface 38. A similarly configured second reclining surface 40 is provided. The upper edges of the side and center walls are at an elevation above the upper edges of the reclining surfaces.

Similarly configured first and second leg dividers 44, 46 are provided. The leg dividers extend vertically from the base adjacent to the front wall. Each leg divider is in a pentagonal configuration. The first leg divider is in the first reclining surface. The second leg divider is in the second reclining surface.

Elbow rests 50 for the care giver are provided next. The elbow rests are located upon the first and second reclining leg dividers above the front edge.

Further provided are first and second mats 54, 56. The mats are removably received in the first and second reclining surfaces. Each mat has an upper end 58. The upper end is positionable at the back edge. Each mat has a lower end 60. The lower end is positionable adjacent to the front edge. The lower edges of the first and second mats have pentagonal cutouts 62. In this manner the first and second leg dividers are received. A C-shaped pillow 64 is provided for each mat. The pillows are removably coupled, preferably by hook and loop fasteners, to each mat adjacent to the back edge. The pillow of each mat is adjustably positioned. In this manner the head of a baby may be properly received.

Provided next is a plurality of slits 68, 70. The slits are formed in each mat and each reclining surface. The slits include laterally spaced longitudinal slits 68. The slits include a lower transverse slit 70. First and second waist straps 72 are provided. The waist straps extend through the longitudinal slits. Crotch straps 74 are provided. Crotch straps extend through the transverse slits. The lower surface of the base has longitudinal and transverse slots 76. In this manner the straps may pass. First and second buckles 78 are provided. The buckles releasably couple the waist and crotch straps. In this manner the babies are secured.

Extended life for the base is achieved through a stiffening sheet 82 on the lower surface of the base. A 2 mil pvc sheet is preferred as the stiffening sheet. Slits extend there through for the passage of the belts. In this manner, wear to the base is abated.

The base is adapted to be fabricated of any of a wide variety of materials. One such material is memory foam with a fabric cover 84 positionable over the base. The fabric cover is fabricated of any of a plurality of materials, natural or synthetic, or blends thereof. The fabric cover is formed with a passageway peripherally along the back and bottom. A separable fastener, preferably a plastic zipper 86, is utilized along the passageway. A variety of other fasteners including hook and loop fasteners, zip-lock type fasteners, snaps, buttons, etc. are also adapted for use in closing the passageway. This allows for the opening and closing purposes. The cover may therefore be removed as for laundering. The cover is adapted to be fabricated of any of a wide range of materials including synthetic and natural fibers and blends thereof. The preferred material is a waterproof 100 percent polyester. Cotton is also a preferred material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baby feeding system comprising:

a base having upper and lower surfaces, the base having front and back edges;

first and second side walls extending from the base, a center wall extending from the base spaced equally between the side walls, the side walls and the center wall having concave upper edges, the upper edges adjacent to the back edge being at an elevation greater than at the front edge, the center wall dividing the system into first and second reclining surfaces, the upper edges of the side and center walls being at an elevation above the upper edges of the reclining surfaces; and similarly configured first and second leg dividers extending vertically from the base adjacent to the front edge, the first and second leg dividers being in the first and second reclining surfaces.

2. The system as set forth in claim 1 and further including:

elbow rests for the care giver located upon the first and second leg dividers above the front edge.

3. The system as set forth in claim 1 and further including:

generally hemispherical projections extending laterally from the base adjacent to the front edge, each projection having an upwardly facing recess for removably receiving a baby bottle.

4. The system as set forth in claim 1 and further including:

first and second mats removably received in the first and second reclining surfaces, each mat having an upper end positionable at the back edge, each mat having a lower end positionable adjacent to the front edge, the lower ends of the first and second mats being formed with cutouts for receiving the first and second leg dividers, a C-shaped pillow removably positioned on each mat adjacent to the back edge, the pillow of each mat being adjustably positioned for properly receiving the head of a baby.

5. The system as set forth in claim 1 and further including:

a plurality of slits formed in each reclining surface, the slits including laterally spaced longitudinal slits and a lower transverse slit, first and second waist straps extending through the longitudinal slits, crotch straps extending through the transverse slits, longitudinal and transverse slots in the lower surface of the base for the passage of the straps, first and second buckles releasably coupling the waist and crotch straps for securement of babies.

6. A baby feeding system (10) for receiving and retaining two laterally spaced babies while feeding and for supporting an elbow of a care giver during feeding, the receiving and retaining and supporting being done in a safe, convenient and economical manner, the system comprising, in combination:

a base (14) having an upper surface (16) and a lower surface (18), the lower surface having a generally rectangular configuration over the majority of its extent, the base having a front edge (20) and a back edge (22), the front edge being wider than the back edge, generally hemispherical projections (24) extending laterally from the base adjacent to the front edge, each projection having an upwardly facing recess a rigid cup-shaped holder positioned in each recess for the removable receipt of a baby bottle;

parallel first and second side walls (28), (30) similarly configured and extending vertical from the base between the front and back edges, a center wall (32) extending vertical from the base parallel with and spaced equally between the side walls, the side walls having concave upper edges (34), the center wall having a concave upper edge (36), the upper edges of the side and center walls adjacent to the back edge being at an elevation greater than at the front edge, the center wall dividing the system into a first reclining surface (38) and a similarly configured second reclining surface (40), the upper edges of the side and center walls being at an elevation above the upper edges of the reclining surfaces;

similarly configured first and second leg dividers (44), (46) extending vertically from the base adjacent to the front wall, each leg divider being in a pentagonal configuration, the first leg divider being in the first reclining surface, the second leg divider being in the second reclining surface;

elbow rests (50) for the care giver located upon the first and second leg dividers above the front edge;

first and second mats (54), (56) removably received in the first and second reclining surfaces, each mat having an upper end (58) positionable at the back edge, each mat having a lower end (60) positionable adjacent to the front edge, the lower edges of the first and second mats being formed with pentagonal cutouts (62) for receiving the first and second leg dividers, a C-shaped pillow (64) removably coupled to each mat adjacent to the back edge, the pillow of each mat being adjustably positioned, by hook and loop fasteners, for properly receiving the head of a baby;

a plurality of slits (68), (70) formed in each mat and each reclining surface, the slits including laterally spaced longitudinal slits (68) and a lower transverse slit (70), first and second waist straps (72) extending through the longitudinal slits, crotch straps (74) extending through the transverse slits, longitudinal and transverse slots (76) in the lower surface of the base for the passage of the straps, first and second buckles (78) releasably coupling the waist and crotch straps for securement of the babies;

a 2 mil pvc stiffening sheet (82) positioned on the lower surface of the base with slits extending there through for the passage of the belts; and the base fabricated of memory foam with a fabric cover (84) positionable over the base, the fabric cover being formed of a waterproof 100 percent polyester with a passageway and a plastic zipper (86) fastener at the passageway peripherally along the back and bottom for the opening and closing thereof whereby the cover may be removed for laundering purposes.

* * * * *